United States Patent [19]

Salvatore

[11] 4,056,106

[45] Nov. 1, 1977

[54] ORTHOPEDIC SHOE CONSTRUCTION

[76] Inventor: Joseph E. Salvatore, 200 Engle St., Englewood, N.J. 07631

[21] Appl. No.: 710,912

[22] Filed: Aug. 2, 1976

[51] Int. Cl.[2] ..... A43B 7/24

[52] U.S. Cl. ..... 128/583

[58] Field of Search ..... 128/583, 584, 585; 36/59 R, 59 A, 59 B, 25 R, 36 R

[56] References Cited

U.S. PATENT DOCUMENTS

| | | | |
|---|---|---|---|
| 3,532,098 | 10/1970 | Rodenberger | 128/583 |
| 3,672,077 | 6/1972 | Coles | 36/59 B X |
| 3,731,323 | 5/1973 | Glancy | 128/583 X |

FOREIGN PATENT DOCUMENTS

| | | | |
|---|---|---|---|
| 42,332 | 7/1933 | France | 36/59 A |
| 2,329,617 | 2/1975 | Germany | 36/59 R |
| 2,161,573 | 6/1973 | Germany | 36/59 R |
| 5,737 of | 1897 | United Kingdom | 36/59 A |
| 20,763 of | 1904 | United Kingdom | 36/59 A |

*Primary Examiner*—John D. Yasko

[57] ABSTRACT

The application of a member in the desired place to the sole of a child's shoe to create a friction surface on one place on the sole causing the shoe to rotate in the proper and necessary direction to effect correction.

12 Claims, 11 Drawing Figures

ORTHOPEDIC SHOE CONSTRUCTION

BACKGROUND OF THE INVENTION

A current method of changing the shoe to correct a rotational foot ailment of a person, particularly a child that rotates the foot in or out, is by placing a wedge on the sole of the shoe creating a high spot. Similar to a tank with one track stopped, such wedge causes rotation of the shoe by virtue of its hitting the ground first and spinning on it at this point. Therefore, correction occurs.

My present invention is to accomplish the same turning or rotation but instead of pivoting on a high spot on the sole of the shoe, I create a friction surface on one spot or place on the sole causing the shoe to rotate, thus effecting correction, without some of the undesirable effects that an elevated wedge causes. (i.e. pronation or supination of the foot.)

The friction surface may either be applied with tape or rubber, or the like, or may be manufactured directly into the sole by the use of such friction material. If the friction surface is placed on the lateral side (5th toe side of the shoe) the shoe will turn or spin outward causing external rotation. Conversely, if the friction surface is placed on the medial surface of the sole, i.e. the great toe side of the sole, then internal rotation or inward turning or rotation occurs.

Heretofore, certain rubber discs were applied to the sole of a shoe with an adhesive, the opposite side having anti-slipping means, such as burlap, but such devices were for anti-skid purposes as described in U.S. Pat. No. 1,747,603. Non-skid patches with ridges were also applied to the sole as described in U.S. Pat. No. 3,561,140. Also, parallel ribs of rubber protruding beyond the surface of the sole were used for the same purpose, as shown in U.S. Pat. No. 3,295,230. Tapered raised portions on the sole and heel were also used to twist the foot back to normal position, as described in U.S. Pat. No. 1,958,097. Correcting the walking angle by elevating the medial side of the shoe with an elevated foresole and heel was also used as shown and described in U.S. Pat. No. 2,615,190. U.S. Pat. No. 3,532,098 provides for a plurality of resilient projections extending from the heel or sole of the shoe, the projections being disposed in pairs one on each of opposite sides of a central point on the member and such projections being formed at an acute angle with respect to the supporting side with the projections on one side of the central point being slanted in a direction opposite to the direction of those on the other side of the central point so that the projections bend in response to the weight of the shoe wearer to cause rotation about such central point in a plane substantially parallel to the member upon ground engagement of the shoe, as described in U.S. Pat. No. 3,532,098. U.S. Pat. No. 3,470,879 reveals a shoe element for heel and/or sole having a plurality of resilient, parallel, spaced ribs, arranged at an acute angle with respect to the longitudinal axis of the element and canted towards one end of that axis. When the ribs engage the ground under the weight of the wearer, the element and shoe shifts laterally to correct "toe-in" or "toe-out", depending upon the direction the ribs are slanted. Likewise, U.S. Pat. No. 3,463,165 reveals a plurality of deformable studs which extend outwardly obliquely from the sole and/or heel of the shoe for deformation upon the application of the weight of the wearer to impart a force to the member which is opposite to the direction of the oblique extension of the studs. However, these patents do not create the friction surface on a specific place on the sole to cause the desired shoe rotation in order to effect the necessary correction required.

An object of my invention is to provide a means of correction individually directed to the correction of specific problems and deformaties of many kinds and types but especially for the younger child where correction at an early age will correct the problem while the child is growing and reduce the period of correction over that heretofore required by conventional devices.

Another object is to provide means capable of effecting such improved correction by friction means while permitting in most cases full mobility of the wearer without certain disadvantages inherent in wedges.

A further object is to provide a friction means on the sole which is inexpensive, easy to apply, or to manufacture, or to remove if necessary, comfortable to use and which does not place undue strain on the wearer.

Other objects and advantages of my invention will become more apparent upon reference to the following description and the accompanying drawings.

DESCRIPTION OF THE PREFERRED EMBODIMENTS

Figure 1:
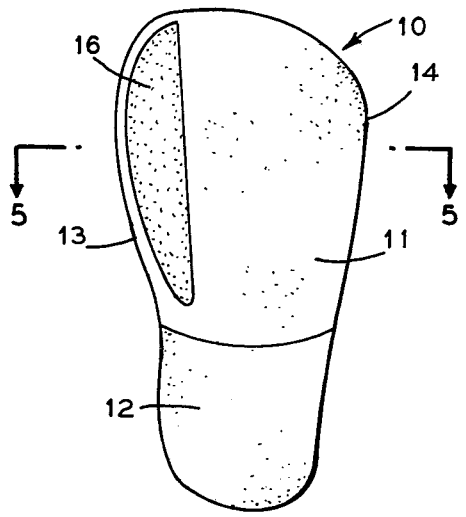
FIG. 1 is a plan view of the bottom or sole and heel portion of a child's shoe showing a friction member applied to or manufactured into the medial surface or great toe portion of the sole.

Referring to the drawings, the sole of a child's shoe embodying the principles of my invention is shown in FIGS. 1 through 6 providing the conventional child's shoe 10 of any design having a sole portion 11 and a heel portion 12 which is made of light-weight leather, plastic, composition rubber or other suitable material. As shown in the figures, the sole has a continuous marginal edge contoured to follow the general shape of the bottom of the child's foot and includes opposite inner and outer side edge portions 13 and 14, respectively. The heel 12 may be formed with the sole 11, or may be rigidly secured to the sole 11 in underlying relation to the heel receiving end 15 of the shoe 10. The sole 11 is provided with a member 16, or one or more hob-nail type of members 17 positioned in a proper place on such sole to create a friction surface to cause the shoe to rotate in the required direction in order to effect correction of the child's shoe and consequently the child's foot. Members 16, 17 may be applied to the surface of sole 11, or be inserted and adhered in a depression in the sole of the same outline as the member, or members 16, 17 and may project slightly above the surface of the sole. The friction member, or members 16, 17 cause rotation of the shoe by virtue of touching the ground and spinning on it at the friction point, thus the required correction occurs. Friction member 16, or members 17, may be made of composition rubber, plastic, mixtures of leather and rubber, or other suitable materials that will provide friction between the friction member of the shoe and the ground. The friction members 16, 17 may be applied to the sole portion 11 by tape, adhesive of a desired type, many of which are on the market, or a specially prepared adhesive created for this purpose.

Figure 2:
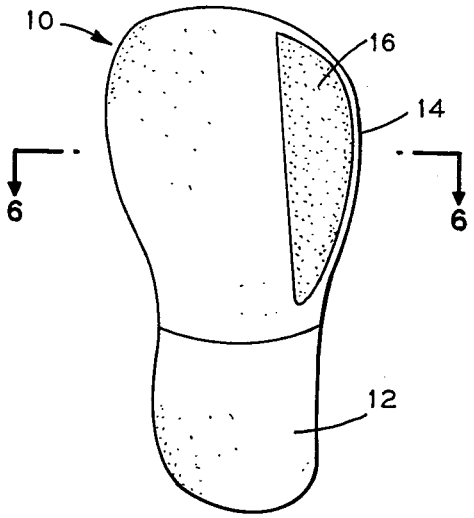
FIG. 2 is a plan view of the bottom or sole and heel portion of a child's shoe showing a friction member applied to or manufactured into the fifth toe or lateral side of the sole.
Figure 3:
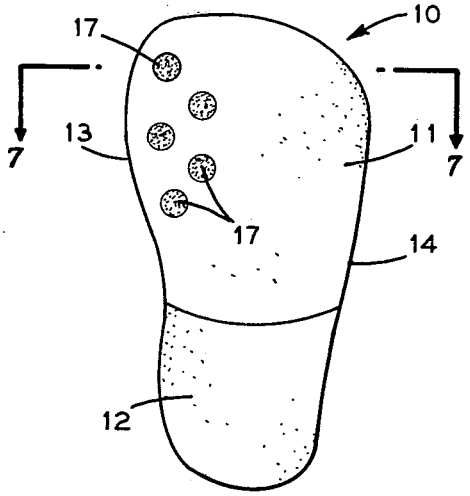
FIG. 3 is a plan view of the bottom sole and heel portion of another child's shoe showing a hob-nail type of friction members which have been applied to or manufactured into the medial or great toe portion of the sole.
Figure 4:
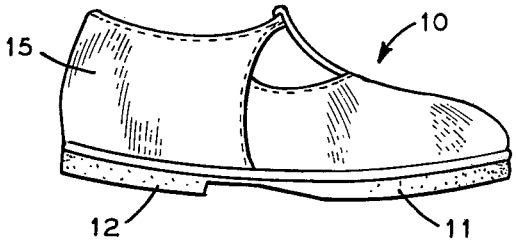
FIG. 4 is a side view of the shoe shown in FIG. 3.
Figure 5:
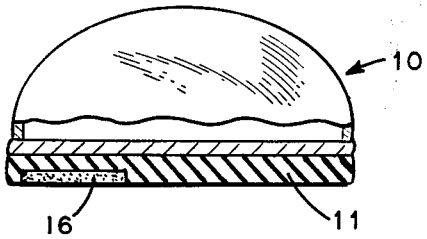
FIG. 5 is a cross sectional view, partially broken away, taken along line 5—5 of FIG. 1.
Figure 6:
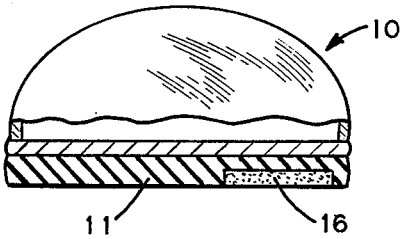
FIG. 6 is a cross sectional view, partially broken away, taken along line 6—6 of FIG. 2.
Figure 7:
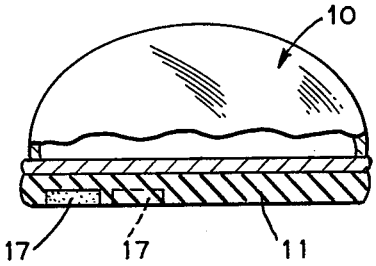
FIG. 7 is a sectional view taken along line 7—7 of FIG. 3 showing hob nails 17 recessed in sole 11.
Figure 7A:
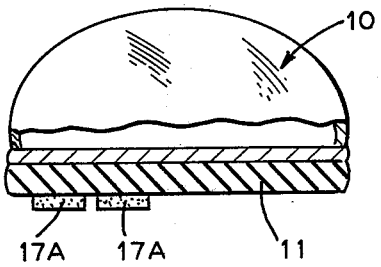
FIG. 7A is an alternate sectional view taken along line 5—5 of FIG. 1 showing pad 16A adhering to the surface of sole 11.
Figure 5A:
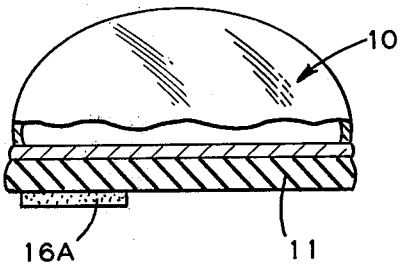
FIG. 5A is an alternate sectional view taken along line 5—5, of FIG. 1 showing pad 16A adhering to the surface of sole 11.
Figure 8:
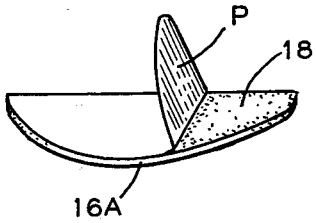
FIG. 8 is a perspective view of pad 16A showing the protective paper P partially peeled back exposing adhesive 18.
Figure 9:
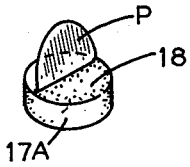
FIG. 9 is a perspective view of hob nail 17A showing protective paper P partially peeled back exposing adhesive 18.

If the friction member or members 16, 17 are placed on the lateral, i.e. the fifth toe side of the shoe, as shown in FIG. 2, the shoe will spin outward causing external rotation. Conversely, if the friction member, or members, are placed on the medial, i.e. the great toe side of the sole surface of the sole, as shown in FIG. 1, then internal rotation or inward spinning occurs.

If the orthopedist, or knowledgeable shoe sales person, prescribes the location the friction member, or members 16, 17 takes on the sole portion 11, children's shoes may be made for commercial sale with such friction member, or the members may be applied by the shoe manufacturer. For example, the hob-nail type of friction members 17 may be applied to the sole in certain positions on shoes by the manufacture so that the shoe may be purchased in different sizes by the child's parents in certain shoe stores that specialize in the sale of children's shoes. Of course, friction patches of various shapes may be made and purchased by the orthopedist for application to the sole of the shoe. Such friction patches may have pressure-sensitive adhesive on one side which is covered by release paper which is pulled away from the adhesive so that the friction member may be applied to the sole of the shoe in the proper and correct area of the sole to cause the shoe to rotate in the right direction to effect correction of the individual child to whom the corrective shoe is to be fitted. The simplicity, economy and prompt effectiveness of such applied friction members for the intended anatomical correcting purpose is evident.

As mentioned above, the features of my invention may be readily and easily incorporated in the original manufacture of the child's shoe, and the friction member, or members, after application to the sole of the shoe is in a permanent and fixed relation with respect to the rest of the shoe and does not involve any looseness, or slipping of the friction member. The features of my invention are important and of particular merit and advantage for application to new and old shoes in accordance with the needs and requirements of the individual child wearer by ordinary skilled footwear repairers and orthopedists. The novelty of the invention is easily and readily explained so that its technique can be taught in lay language to the shoe repairer in a short time and he can be prepared to incorporate my friction members to the sole of the shoe in a relatively short period.

I claim:

1. A shoe having an upper and a sole and heel portion,
an orthopedic friction corrective member attached to said sole portion,
said sole portion having generally a flat outer surface,
said friction member positioned at the great toe side of said sole portion to retard the movement of said shoe when said shoe engages the ground under the weight of the wearer of said shoe creating a friction surface at the point of application of said friction member whereby internal rotation is caused at said great toe side of said sole portion of said shoe turning said shoe inwardly in the direction of the position of said friction member when said friction member engages the ground.

2. The friction member and shoe according to claim 1 wherein said sole portion has at least one friction member thereon.

3. The friction member for the sole of a shoe according to claim 1 wherein said friction member comprises several units positioned relatively close together.

4. The friction member for the sole of a shoe according to claim 1 wherein said units are of a hob-nail type.

5. The friction member according to claim 1 wherein said friction member has an adhesive material on one side and a removable covering for said adhesive material or manufactured directly into the sole.

6. The friction member according to claim 1 wherein said friction member may be level with the sole or extended thicker than the sole.

7. A shoe having an upper and a sole and heel portion,
an orthopedic friction corrective member attached to said sole portion,
said sole portion having generally a flat outer surface,
said friction member positioned at about the lateral fifth toe side of said sole portion to retard the movement of said shoe when said shoe engages the ground under the weight of the wearer of said shoe creating a friction surface at the point of application of said friction member whereby external rotation is caused at said lateral fifth toe side of said sole portion of said shoe turning said shoe outwardly in the direction of the position of said friction member when said friction member engages the ground.

8. The shoe and friction member according to claim 7 wherein said sole portion has at least one friction member thereon.

9. The shoe and friction member according to claim 7 wherein said friction member comprises several units positioned relatively close together.

10. The shoe and friction member according to claim 7 wherein said units are of a hob-nail type.

11. The shoe and friction member according to claim 7 wherein said friction member has an adhesive material on one side and a removable covering for said adhesive material or manufactured directly into said sole.

12. The shoe and friction member according to claim 7 wherein said friction member may be level with said sole or extended thicker than said sole.

* * * * *